US006934486B2

(12) United States Patent
Lee

(10) Patent No.: US 6,934,486 B2
(45) Date of Patent: Aug. 23, 2005

(54) HARD IMAGING DEVICE VAPOR REMOVAL SYSTEMS, HARD IMAGING DEVICES, AND HARD IMAGING METHODS

(75) Inventor: Michael H. Lee, San Jose, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/459,036

(22) Filed: Jun. 10, 2003

(65) Prior Publication Data

US 2004/0253017 A1 Dec. 16, 2004

(51) Int. Cl.[7] ..... G03G 15/11; G03G 21/00

(52) U.S. Cl. ..... 399/92; 399/44; 399/237; 399/250

(58) Field of Search ..... 399/251, 250, 399/237, 92, 93, 94, 97, 9, 44

(56) References Cited

U.S. PATENT DOCUMENTS

| | | | | |
|---|---|---|---|---|
| 4,676,859 | A | | 6/1987 | Cleary, Jr. et al. |
| 5,946,528 | A | | 8/1999 | Cho |
| 6,041,201 | A | | 3/2000 | Kim |
| 6,204,936 | B1 | | 3/2001 | Ishizuka |
| 6,339,688 | B1 | | 1/2002 | Cho et al. |
| 6,496,674 | B2 | * | 12/2002 | Pang et al. ..... 399/250 |
| 2001/0017997 | A1 | * | 8/2001 | Saitoh ..... 399/250 |
| 2001/0026696 | A1 | | 10/2001 | Yokota et al. |
| 2002/0031373 | A1 | | 3/2002 | Yoshikawa |
| 2002/0051656 | A1 | | 5/2002 | Yokota |
| 2002/0090233 | A1 | * | 7/2002 | Choi ..... 399/251 |

FOREIGN PATENT DOCUMENTS

| | | | |
|---|---|---|---|
| EP | 0435520 | | 7/1991 |
| EP | 0529561 | | 10/1997 |
| JP | 08-190276 | * | 7/1996 |
| JP | 2002-268393 | * | 9/2002 |
| JP | 2002-268393 A | * | 9/2002 |

* cited by examiner

*Primary Examiner*—Sophia S. Chen

(57) ABSTRACT

Hard imaging device vapor removal systems, hard imaging devices, and hard imaging methods are described. According to one embodiment, a hard imaging device vapor removal system includes a supply path configured to supply air to an imaging region of a hard imaging device configured to use a liquid ink marking agent to form a plurality of hard images using media, wherein the air of the supply path is supplied to remove a carrier vapor of the liquid ink marking agent resulting from imaging operations of the hard imaging device, an exhaust path configured to remove at least some of the carrier vapor externally of the imaging region using the supplied air, and a bypass path configured to supply supplemental air to the supplied air exhausting the carrier vapor of the liquid ink marking agent.

47 Claims, 3 Drawing Sheets

HARD IMAGING DEVICE VAPOR REMOVAL SYSTEMS, HARD IMAGING DEVICES, AND HARD IMAGING METHODS

FIELD OF THE INVENTION

Aspects of the invention relate to hard imaging device vapor removal systems, hard imaging devices, and hard imaging methods.

BACKGROUND OF THE INVENTION

Computer systems including personal computers, workstations, hand held devices, etc. have been utilized in an increasing number of applications at home, the workplace, educational environments, entertainment environments, etc. Peripheral devices of increased capabilities and performance have been developed and continually improved upon to extend the functionality and applications of computer systems. For example, imaging devices, such as digital presses or printers, have experienced significant advancements including refined imaging, faster processing, and color reproduction.

Presses or printers may use different marking agents to form hard images. Some configurations use dry toner or liquid ink marking agents. Liquid ink marking agents may initially comprise a carrier fluid and ink. During imaging operations, at least some of the carrier fluid may be left to evaporate as the ink is applied to media. Relatively heavy carrier fluids may be additionally heated to minimize permeation of the fluids into the media being imaged. Also, heat may be used to affix a developed image to media (e.g., heating a blanket (drum) or other component of the device).

It is desired to remove the carrier fluid from the imaging area of the device. Exemplary solutions include blowing relatively significant amounts of air into the imaging area, and providing suction to remove the carrier fluid. The presence of the air may result in significant heat loss with respect to configurations wherein heat is utilized to minimize permeation of the carrier fluid, affix a developed image to media, and/or otherwise assist with imaging operations.

Referring to FIG. 1, one conventional arrangement for removing carrier fluids in a liquid imaging system is shown. The system includes a blanket (i.e., drum) 1 rotating in a clockwise direction 2. A metal shroud 3 is provided to circulate air adjacent to the blanket 1. For example, an inlet 4 may receive air 5, guide the air 5 adjacent to blanket 1, and exhaust air 7 including carrier vapor through an outlet 6.

More recently, there has been a heightened awareness with respect to energy consumption by imaging and other electronic devices. Passing air through an imaging area of the device of FIG. 1 may result in significant amounts of heat loss, which is replaced using heat generated by electrical heaters in some configurations. Devices and methods having improved efficiency are provided according to at least some embodiments described below.

SUMMARY OF THE INVENTION

Aspects of the invention relate to hard imaging device vapor removal systems, hard imaging devices, and hard imaging methods.

According to one embodiment, a hard imaging device vapor removal system comprises a supply path configured to supply air to an imaging region of a hard imaging device configured to use a liquid ink marking agent to form a plurality of hard images using media. The air of the supply path is supplied to remove a carrier vapor of the liquid ink marking agent resulting from imaging operations of the hard imaging device. An exhaust path is also provided and configured to remove at least some of the carrier vapor externally of the imaging region using the supplied air. A bypass path is used to supply supplemental air to the supplied air exhausting the carrier vapor of the liquid ink marking agent.

According to yet another embodiment, a hard imaging method comprises providing a hard imaging device configured to form a plurality of hard images using media. The hard imaging device may access image data to form a hard image using a liquid ink marking agent at a given location in the hard imaging device. A carrier vapor is produced during the forming of the hard images, and the method further includes removing the carrier vapor from the given location using an initial quantity of air, and providing an additional amount of air during the removing at a different location than the given location.

Other embodiments and aspects are disclosed.

DETAILED DESCRIPTION OF THE INVENTION

According to at least some embodiments or aspects, apparatus and methods for increasing energy efficiency during hard imaging operations are described according to exemplary configurations. Although other arrangements are possible, exemplary embodiments herein include hard imaging devices or methods which use liquid ink marking agents to form hard images.

Figure 1:
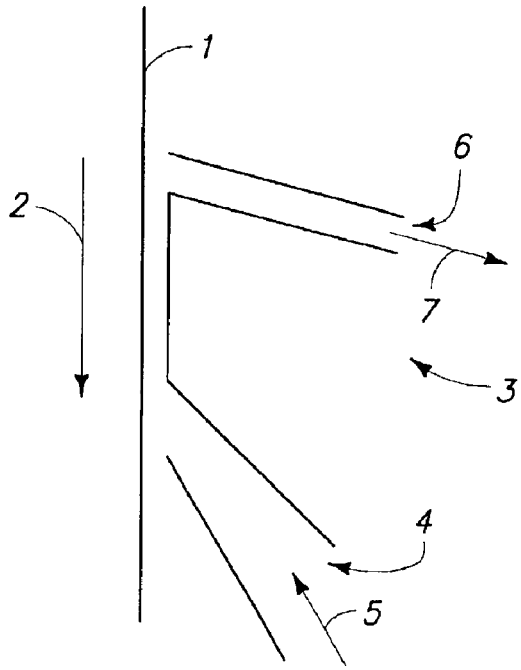
FIG 1 PRIOR ART
FIG. 1 is an illustrative representation of a shroud of a prior art printing apparatus.
Figure 2:
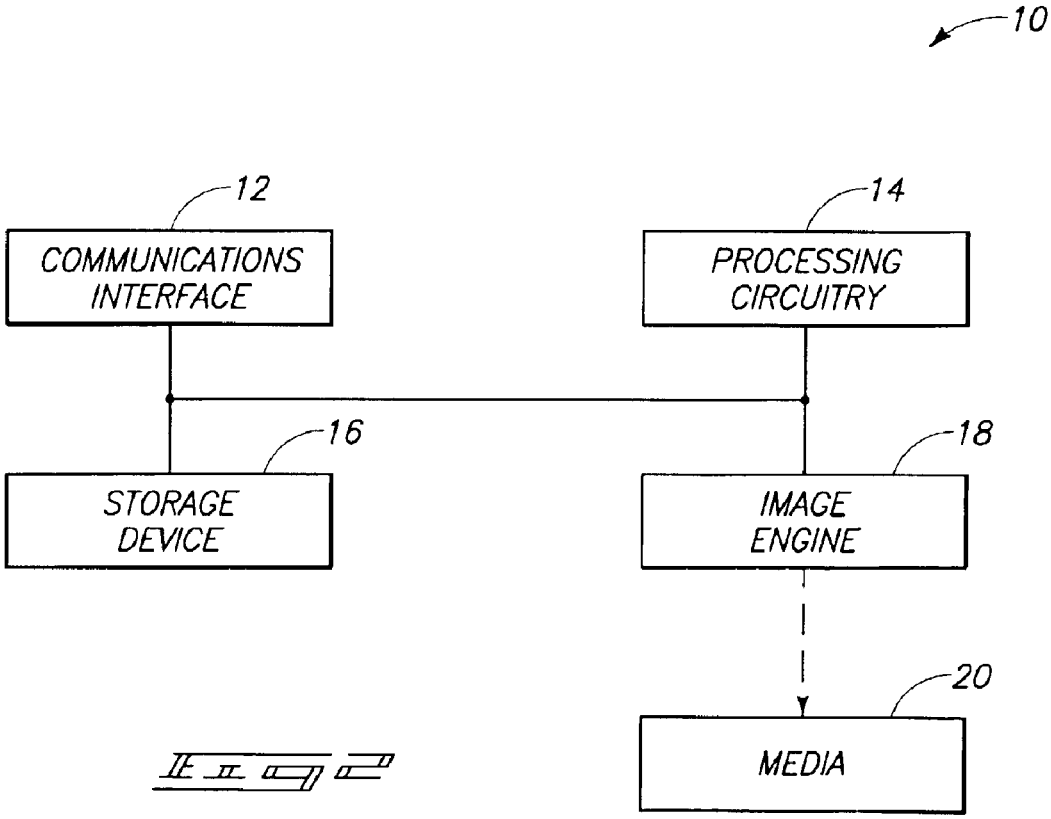
FIG. 2 is a functional block diagram of a hard imaging device according to one embodiment.

FIG. 2 shows an exemplary configuration of a hard imaging device 10. Hard imaging device 10 is configured to form hard images. Hard images comprise images physically rendered upon output media 20, such as sheet paper, roll paper, envelopes, transparencies, labels, etc. Hard imaging device 10 may be implemented as an electrophotographic digital press (e.g., an HP1000 or HP3000 Indigo press available from Hewlett-Packard Company) in one embodiment. Other possible embodiments of hard imaging device 10 include laser printers, copiers, facsimile devices, multiple function peripheral (MFP) devices, or any other configuration arranged to form hard images upon media 20.

The illustrated exemplary hard imaging device 10 includes a communications interface 12, processing circuitry 14, a storage device 16, and an image engine 18. The depicted example of hard imaging device 10 comprises a digital press for discussion purposes. Other implementations are possible as mentioned previously.

Communications interface 12 is configured to communicate electronic data externally of hard imaging device 10. In one embodiment, interface 12 is arranged to provide input/output communications with respect to external devices, via for example, a communications medium (not shown) implemented as a networked arrangement of private and/or public devices.

Processing circuitry 14 is configured to access and process image data (e.g., rasterize the image data) and control operations of hard imaging device 10 (e.g., communications, imaging, etc.). Processing circuitry 14 may comprise circuitry configured to implement desired programming (e.g., a microprocessor or other structure configured to execute software and/or firmware instructions). Other exemplary embodiments of processing circuitry 14 include hardware logic, PGA, FPGA, ASIC, and/or other processing structures. These examples of processing circuitry 14 are for illustration and other configurations are possible for processing image data and controlling operations of hard imaging device 10.

Storage device 16 is configured to store electronic data, programming such as executable instructions (e.g., software and/or firmware), and/or other digital information and may include processor-usable media. Processor-usable media includes any article of manufacture which can contain, store, or maintain programming, data and/or digital information for use by or in connection with an instruction execution system including processing circuitry in the exemplary embodiment. For example, exemplary processor-usable media may include any one of physical media such as electronic, magnetic, optical, electromagnetic, infrared or semiconductor media. Some more specific examples of processor-usable media include, but are not limited to, a portable magnetic computer diskette, such as a floppy diskette, zip disk, hard drive, random access memory, read only memory, flash memory, cache memory, and/or other configurations capable of storing programming, data, or other digital information.

Image engine 18 is configured to form hard images upon output media 20. In one embodiment, image engine 18 comprises development and fusing assemblies configured to form the hard images using a marking agent, such as a liquid ink marking agent. Image engine 18 may be configured to generate monochrome and/or color hard images.

Figure 3:
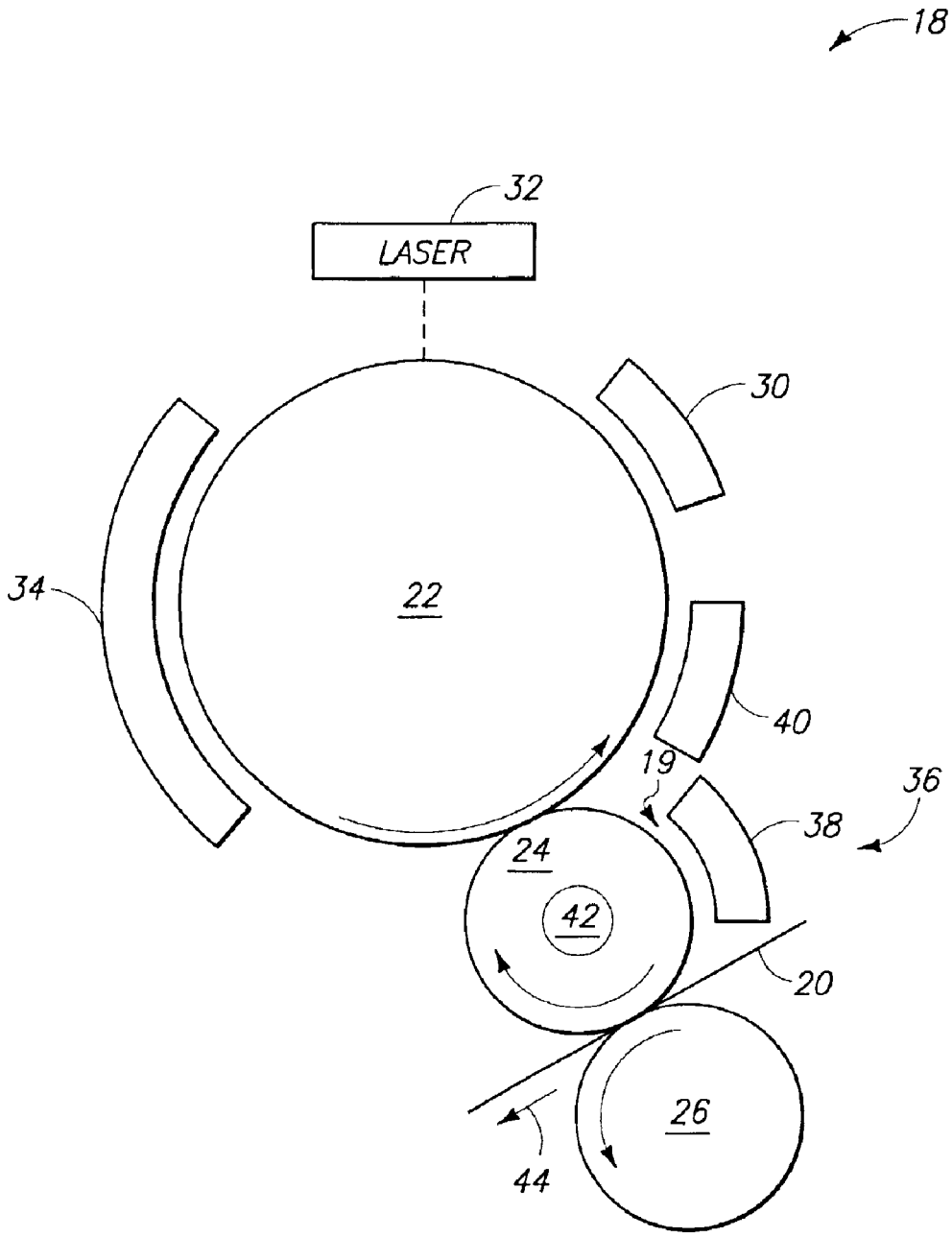
FIG. 3 is an illustrative representation of an imaging engine according to one embodiment.

Referring to FIG. 3, further details of image engine 18 implemented as an exemplary electrophotographic engine of a color digital press is shown. The image engine 18 is configured to form hard images upon media 20. In the described example, image engine 18 forms latent images, develops the latent images, and affixes the developed images to media. The illustrated image engine 18 is configured to develop and affix images using a liquid ink marking agent. Other components or configurations of imaging engine 18 may be provided to form hard images.

The depicted image engine 18 comprises a photoconductor 22, a transfer blanket 24 (also referred to as a transfer drum), a pressure drum 26, a charging device 30, a laser 32, a development assembly 34, a vapor removal system 36, and a cleaning unit 40.

Photoconductor 22 rotates counter-clockwise for receiving latent images, developing the latent images using a marking agent, and transferring the developed images to transfer blanket 24 during imaging operations. Charging device 30 may be implemented using one or more scorotron configured to provide an electrical charge to photoconductor 22. Laser 32 is controlled responsive to appropriate rasterized image data to selectively discharge charged portions of photoconductor 22 to form a latent image. Development assembly 34 may comprise one or more station for providing one or more marking agent to photoconductor 22 to develop the latent image. For color embodiments, development assembly 34 may comprise a plurality of colorants (CMYK) to develop the latent images.

Developed latent images are transferred from photoconductor 22 to transfer blanket 24. Transfer blanket 24 comprises a heater 42 configured to heat the marking agent of the developed image upon the transfer blanket 24.

Media 20 passes intermediate transfer blanket 24 and pressure drum 26 in a media path direction 44. The marking agent of the developed image is transferred from the transfer blanket 24 to the media 20 during passage of media 20 through a nip of transfer blanket 24 and pressure drum 26.

As mentioned above, the marking agent may comprise liquid ink in at least some embodiments. During imaging operations of device 10 (e.g., development and transfer operations), a carrier fluid of the liquid ink marking agent may be separated from the ink. Vapor removal system 36 is configured to remove at least some of the carrier fluid resulting from the imaging operations. The carrier fluid may be within a liquid state and a vapor state. Vapor removal system 36 is arranged to remove at least some of the carrier fluid in a gaseous state (also referred to as carrier vapor) and may also remove liquid portions of the carrier fluid. In the illustrated embodiment, vapor removal system 36 may comprise a shroud 38 adjacent to transfer blanket 24. An area intermediate shroud 38 and transfer blanket 24 may be generally referred to as an exemplary imaging region 19 wherein carrier vapors are typically present during imaging. Vapor removal system 36 may be located or configured to remove carrier vapors from other imaging regions in other embodiments. Vapor removal system 36 may comprise additional components in other embodiments as described below with respect to the exemplary configuration of FIG. 4.

Cleaning unit 40 may apply a thin oil layer to photoconductor 22 and remove the oil to implement cleaning. Cleaning unit 40 may also include a scraping apparatus to remove any remaining residue from a surface of photoconductor 22.

Figure 4:
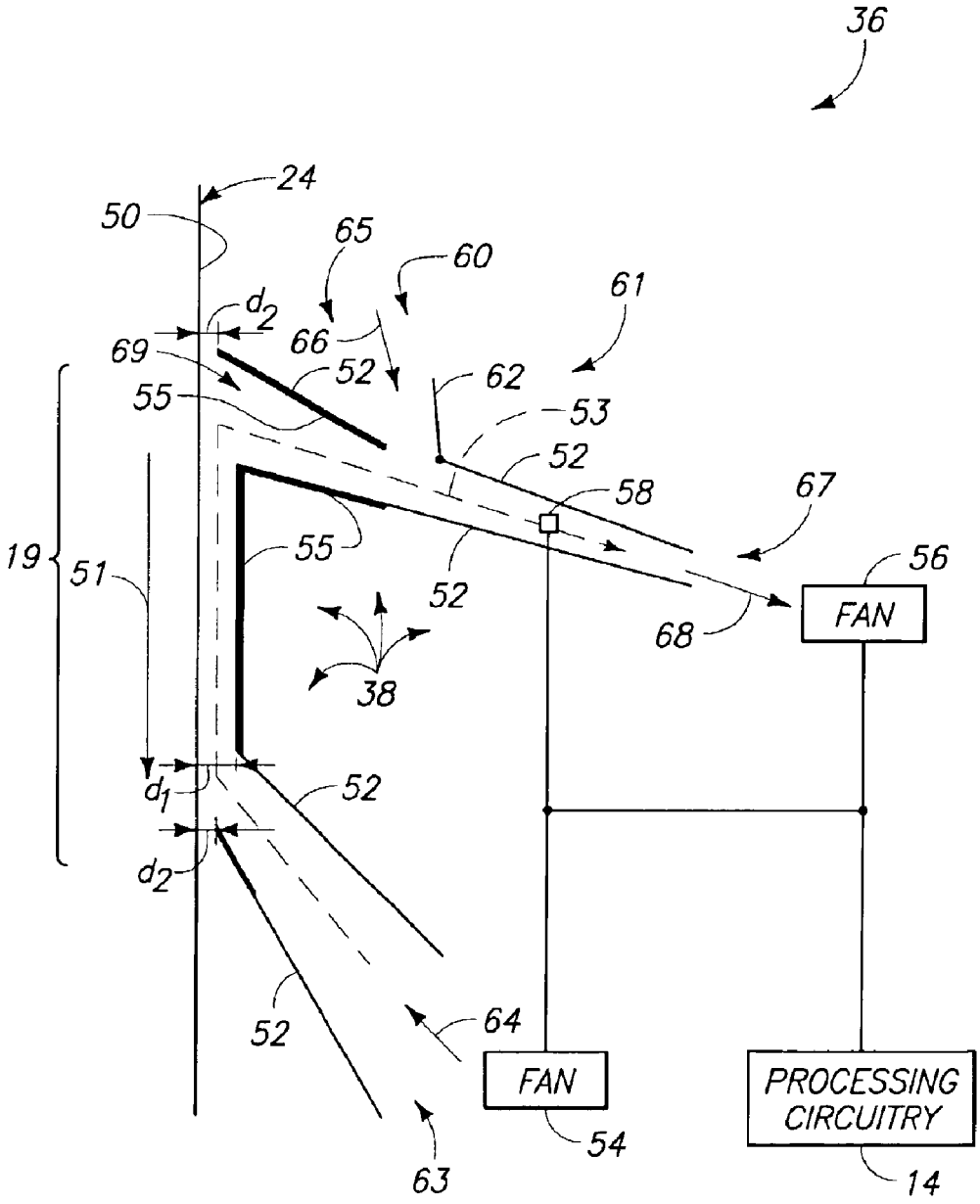
FIG. 4 is an illustrative representation of a vapor removal system according to one embodiment.

Turning to FIG. 4, the illustrated vapor removal system 36 includes processing circuitry 14, a shroud 38, a supply fan 54, an exhaust fan 56, a temperature sensing device 58, and a bypass system 60. Other embodiments are possible including less, more or other components. Transfer blanket 24 having a surface 50 adjacent to the vapor removal system 36 is configured to rotate in a downwardly direction 51 in FIG. 4.

Shroud 38 comprises a plurality of walls 52 arranged to define a supply path 63 corresponding to the illustrated supply air 64, a bypass path 65 corresponding to the illustrated supplemental or additional air 66, and an exhaust path 67 corresponding to exhaust air 68. In one embodiment, the supply path 63 and exhaust path 67 define an air path 53 from the supply to the exhaust of shroud 38. Supplied air 64 blows carrier vapor present at imaging region 19 into an entrance 69 of exhaust path 67 for exhaustion from imaging region 19. Supply air 64 may comprise ambient (or fresh) air provided from an area internal of a housing (not shown) of device 10, from a port coupled with an exterior portion of the housing of device 10, or other appropriate supply. Supply fan 54 may increase an amount of supplied air 64 and exhaust fan 56 provides a suction to remove exhaust air comprising supply air 64 and carrier vapor from imaging region 19, and bypass air 66 (if bypass air 66 is present). In some arrangements, supply fan 54 and/or exhaust fan 56 are omitted. For example, supply air 64 may be drawn by suction of fan 56 into air path 53 without the use of supply fan 54.

At least some aspects described herein aim to improve the efficiency of hard imaging device 10 including reducing or minimizing the heat lost through vapor removal operations.

As mentioned previously, transfer blanket 24 may be heated during imaging operations. Some of the described aspects aim to reduce or minimize heat loss during the vapor removal operations.

Accordingly, in one embodiment, walls 52 of shroud 38 may be formed of a material having a relatively high thermal conductivity (e.g., metal). At least some of the walls 52 comprising portions of shroud 38 adjacent to imaging region 19 may be coated or otherwise comprise a thermally insulative material 55 (e.g., plastic) having a thermal conductivity less than a material of walls 52. In the depicted embodiment, thermally insulative material 55 is provided at the wall 52 opposite to surface 50 of transfer blanket 24 and at walls 52 forming a portion of the exhaust path 67. In other embodiments, thermally insulative material 55 may be omitted (e.g., embodiments wherein walls 52 are formed of a material having a relatively low thermal conductivity).

Additional aspects to reduce or minimize heat loss radiating from transfer blanket 24 provide a reduced or minimal cross-sectional area within imaging region 19 defined by shroud 38 and surface 50 of transfer blanket 24. In one embodiment, a dimension d1 of approximately 1–2 millimeters is provided between surface 50 and wall 52 parallel with surface 50 as shown in FIG. 4. Dimensions d2 are defined between surface 50 and walls 52 defining supply path 63 and exhaust path 67. In one embodiment, it is desired to minimize or reduce a quantity of air entering path 53 via spaces corresponding to dimensions d2 adjacent the supply path 63 and the exhaust path 67. It is believed that a ratio of dimensions d1:d2 of approximately 6–8:1 is sufficient to provide proper carrier vapor removal without excessive heat loss. Accordingly, d1 may be 2 mm and d2 may be 250 microns in one embodiment.

In additional aspects, bypass system 60 aids with reducing heat loss and improving thermal efficiency during vapor recovery. In one embodiment, bypass system 60 including bypass path 65 is located or positioned to provide supplemental or bypass air 66 to air path 53 at a position intermediate imaging region 19 and exhaust fan 56 or other outlet of the exhaust path 67. In one embodiment, supplemental air 66 comprises ambient (or fresh) air present within a housing of device 10, brought in using a port to the exterior of such a housing, or otherwise appropriately supplied.

Bypass system 60 supplies supplemental air 66 via bypass path 65 to supplied air 64 operating to exhaust the carrier vapor. As shown in accordance with the depicted exemplary embodiment, bypass path 65 of the bypass system 60 is arranged to provide bypass air 66 at a position in air path 53 downstream from imaging region 19 and entrance 69 of exhaust path 67. In one arrangement, the bypass path 65 supplies supplemental air 66 not comprising the carrier vapor to supply air 64 which may be operating to remove the carrier vapor from imaging region 19. Bypass path 65 supplies supplemental air 66 to air path 53 at a location different than locations of imaging region 19 and/or supply path 63 in the illustrated embodiment. Supplied air 64 may comprise an initial quantity of air and the supplemental air 66 may supplement the initial quantity. Exhaust air 68 may be directed into an appropriate vapor recovery system, external to a housing of device 10, or other appropriate location.

In one aspect, the provision of supplemental air 66 within air path 53 according to the illustrated exemplary embodiment allows unheated air (e.g., air not heated by imaging area 19) to assist with exhaustion or removal of carrier vapors. Provision of bypass path 65 using substantially unheated or ambient supplemental air 66 reduces a portion of shroud 38 which may be heated above ambient thereby improving the thermal efficiency of device 10. Further, supplemental air 66 assists with exhaustion or removal of the carrier vapor as it cools following imaging thereby reducing an amount of supplied air 64 otherwise utilized for exhaustion or removal.

Bypass system 60 may comprise components or implement operations in addition to the previously described structure or operations of bypass path 66. For example, bypass system 60 may comprise a flow adjuster 61 configured to adjust an amount of air flowing within bypass path 66 at a given moment in time. An exemplary flow adjuster 61 may include a movable flap or wall 62 and a motor (not shown) operable to adjust a position of wall 62 (wall 62 may be fixed or omitted in arrangements wherein the flow of air within bypass path 66 is not adjustable or is adjusted in another way).

In certain embodiments, processing circuitry 14 may control vapor removal operations (e.g., controlling a speed of one or both of fans 54, 56, a position of wall 62, etc.). The control may be responsive to monitoring of operations of device 10 (e.g., counting a number of pixels imaged upon media 20 or over a given period of time to determine an amount of marking agent used, monitoring temperature via temperature sensing device 58, etc.).

In a more specific example, it may be assumed an increased amount of carrier vapor will be present if an increased number of pixels are imaged, and accordingly, processing circuitry 14 may operate to increase the size of the opening of bypass path 65 by controlling the position of wall 62. Processing circuitry 14 may control the motor of flow adjuster 61 to adjust a position of wall 62 to a plurality of possible positions from a substantially closed position wherein no or minimal supplemental air 66 is introduced to air path 53, to a fully open position wherein a maximum amount of supplemental air 66 is supplied. Alternately or additionally, processing circuitry 14 can increase an amount of supplied air 64 provided via fan 54, and/or exhaust air 68 removed via fan 56. In another arrangement, a bypass fan (not shown) may be provided to control the flow of supplemental air 66 and the bypass fan could also be controlled by processing circuitry 14.

Processing circuitry 14 may monitor a temperature of exhaust air 68 comprising carrier vapor within exhaust path 67 and operate to implement and/or adjust vapor removal operations. In some arrangements, it may be desired to maintain a temperature of the carrier vapor being exhausted below a certain maximum temperature to avoid accidental ignition of the carrier vapor. For example, if the carrier fluid comprises ISOPAR type L carrier fluid available from Exxon Mobil Corporation, it is desired to maintain the temperature of the carrier vapor below approximately 58° C. Processing circuitry 14 may monitor the temperature via device 58 and selectively adjust positioning of wall 62 and/or speed of fans 54, 56 (i.e., adjusting an amount of supplied and/or supplemental air within air path 53) to reduce or otherwise adjust the temperature of the carrier vapor to maintain an appropriate desired temperature of the carrier vapor as well as minimize heat loss.

The protection sought is not to be limited to the disclosed embodiments, which are given by way of example only, but instead is to be limited only by the scope of the appended claims.

What is claimed is:

1. A hard imaging device vapor removal system comprising:

a supply path configured to supply air to an imaging region of a hard imaging device configured to use a liquid ink marking agent to form a plurality of hard images using media, wherein the air of the supply path is supplied to remove a carrier vapor of the liquid ink marking agent resulting from imaging operations of the hard imaging device;

an exhaust path configured to remove at least some of the carrier vapor externally of the imaging region using the supplied air; and a bypass path configured to supply supplemental air to the supplied air exhausting the carrier vapor of the liquid ink marking agent.

2. The system of claim 1 further comprising a flow adjuster configured to adjust an amount of supplemental air supplied using the bypass path.

3. The system of claim 1 further comprising processing circuitry configured to monitor imaging operations of the hard imaging device and to adjust a vapor removal operation responsive to the monitoring.

4. The system of claim 1 further comprising a temperature sensing device configured to monitor temperature within the exhaust path, and processing circuitry configured to adjust a vapor removal operation responsive to the monitoring.

5. The system of claim 4 wherein the processing circuitry is configured to adjust a speed of a fan to adjust the vapor removal operation.

6. The system of claim 1 wherein the bypass path is configured to supply the supplemental air comprising air not heated by the imaging region.

7. The system of claim 1 wherein the bypass path is configured to supply the supplemental air not comprising the carrier vapor to the exhaust path.

8. The system of claim 1 wherein the supply path and exhaust path define an air path, and wherein the bypass path is configured to supply the supplemental air to the air path at a position downstream from the imaging region of the hard imaging device.

9. The system of claim 1 wherein a shroud defines the supply path, the exhaust path, and the bypass path, and wherein portions of the shroud adjacent to the imaging region have reduced thermal conductivity compared with other portions of the shroud.

10. The system of claim 1 wherein the supply path and exhaust path define an air path, and wherein the bypass path is configured to supply the supplemental air at a position of the air path downstream from an entrance to the exhaust path.

11. The system of claim 1 wherein the supplemental air is void of the carrier vapor prior to being supplied to the supplied air.

12. The system of claim 1 further comprising a vapor removal system configured to receive the supplied air and the supplemental air comprising the carrier vapor from respective ones of the exhaust path and the bypass path.

13. A hard imaging device comprising:

an image engine configured to use a liquid ink marking agent to form a plurality of hard images using media, wherein a carrier vapor of the liquid ink marking agent is produced during the forming of the hard images;

processing circuitry configured to control the image engine to form the hard images; and a vapor removal system comprising:

an air path adjacent at least an imaging region of the image engine and configured to flow air within the air path to remove at least some of the carrier vapor from the imaging region of the image engine; and a bypass path configured to provide supplemental air to the air path at a location of the air path downstream from the imaging region of the image engine;

wherein the air within the air path is not recirculated to the imaging region.

14. The device of claim 13 wherein the image engine comprises a print engine of a digital press.

15. The device of claim 13 further comprising a flow adjuster configured to adjust an amount of supplemental air supplied using the bypass path.

16. The device of claim 15 wherein the processing circuitry is configured to monitor imaging operations of the hard imaging device and to control the flow adjuster to control the amount of supplemental air supplied using the bypass path.

17. The device of claim 13 wherein the bypass path is configured to supply the supplemental air not comprising the carrier vapor.

18. The device of claim 13 wherein the bypass path joins the air path at a position downstream from the imaging region of the hard imaging device.

19. The device of claim 13 wherein the bypass path is configured to provide the supplemental air at a position of the air path downstream from an entrance to the exhaust path.

20. The device of claim 13 wherein the supplemental air provided to the air path is void of the carrier vapor prior to being supplied to the air path.

21. A hard imaging device comprising:

imaging means for using a liquid ink marking agent for forming a plurality of hard images using media, wherein a carrier vapor of the liquid ink marking agent is produced during the forming;

processing means for controlling the imaging means during the forming of the hard images;

air supply means for supplying air to remove at least some of the carrier vapor from the imaging means; and bypass means for supplying supplemental air to the air removing the at least some carrier vapor.

22. The device of claim 21 wherein the supplied air is provided in an air path, and the bypass means comprises means for supplying the supplemental air to the air path at a location of the air path downstream from the imaging means.

23. The device of claim 21 further comprising air exhausting means for providing a suction of the air removing the carrier vapor, and wherein the bypass means is positioned intermediate the imaging means and the air exhausting means.

24. The device of claim 21 wherein the supplemental air is void of the carrier vapor prior to being supplied to the air removing the at least some carrier vapor.

25. The device of claim 21 further comprising:

housing means for housing the imaging means; and exhaust means for exhausting the supplemental air and the air removing the at least some of the carrier vapor externally of the housing.

26. A hard imaging method comprising:

providing a hard imaging device configured to form a plurality of hard images using media;

using the hard imaging device, accessing image data;

using the hard imaging device, forming a hard image using a liquid ink marking agent responsive to the accessed image data at a given location in the hard imaging device, wherein a vapor carrier is produced during the forming;

removing the carrier vapor from the given location using an initial quantity of air;

providing an additional amount of air during the removing and at a different location than the given location; and wherein the providing the additional amount of air comprises providing the additional amount of air to the initial quantity of air comprising the carrier vapor.

27. The method of claim 26 further comprising:

monitoring the forming the hard image; and adjusting the additional amount of air provided responsive to the monitoring.

28. The method of claim 26 wherein the removing comprises removing using an air path, and the providing the additional amount of air comprises providing the additional amount of air to the air path at the different location positioned downstream from the given location.

29. The method of claim 26 further comprising:

monitoring temperature of air removing the carrier vapor; and adjusting a vapor removal operation responsive to the monitoring of the temperature.

30. The method of claim 29 wherein the adjusting comprises adjusting a speed of a fan.

31. The method of claim 26 wherein the additional amount of air is void of the carrier vapor before the providing the additional amount of air to the different location.

32. The method of claim 26 further comprising preventing the initial quantity of air and the additional amount of air from being recirculated to the given location after the removing and the providing the additional amount of air.

33. A hard imaging method comprising:

providing a hard imaging device configured to form a plurality of hard images using media;

using the hard imaging device, accessing image data;

using the hard imaging device, forming a hard image using a liquid ink marking agent and the image data;

exhausting a carrier vapor resulting from the forming of the hard image using the liquid ink marking agent;

adjusting a temperature of the carrier vapor during the exhausting; and wherein the exhausting comprises initially removing the carrier vapor using an initial quantity of air, and supplementing the initial quantity of air with supplemental air after the initially removing.

34. The method of claim 33 further comprising:

monitoring the forming the hard images; and adjusting the temperature responsive to the monitoring.

35. The method of claim 33 wherein the exhausting comprises exhausting using air supplied at a plurality of different locations.

36. The method of claim 33 wherein the adjusting comprises increasing an amount of the supplemental air provided to supplement the initial quantity of air.

37. The method of claim 33 further comprising monitoring the temperature of the carrier vapor and the adjusting is responsive to the monitoring.

38. The method of claim 33 wherein the adjusting comprises reducing the temperature.

39. The method of claim 33 wherein the supplemental air is void of the carrier vapor before the supplementing.

40. A hard imaging method comprising:

providing a hard imaging device configured to form a plurality of hard images using media;

using the hard imaging device, accessing image data;

using the hard imaging device, forming a hard image using a liquid ink marking agent responsive to the accessed image data at a given location in the hard imaging device, wherein a vapor carrier is produced during the forming;

removing the carrier vapor from the given location using an initial quantity of air;

providing an additional amount of air to the initial quantity of air during the removing using the initial quantity of air and wherein the providing the additional amount of air comprises providing at a different location than the given location;

monitoring the forming the hard image; and adjusting the additional amount of air provided responsive to the monitoring.

41. The method of claim 40 further comprising directing the initial quantity of air and the additional amount of air external of a housing of the hard imaging device after the removing and the providing the additional amount of air.

42. A hard imaging method comprising:

providing a hard imaging device configured to form a plurality of hard images using media;

using the hard imaging device, accessing image data;

using the hard imaging device, forming a hard image using a liquid ink marking agent responsive to the accessed image data at a given location in the hard imaging device, wherein a vapor carrier is produced during the forming;

removing the carrier vapor from the given location using an initial quantity of air;

providing an additional amount of air during the removing and at a different location than the given location;

monitoring temperature of air removing the carrier vapor; and adjusting a vapor removal operation responsive to the monitoring of the temperature.

43. The method of claim 42 wherein the adjusting comprises adjusting a speed of a fan.

44. A hard imaging method comprising:

providing a hard imaging device configured to form a plurality of hard images using media;

using the hard imaging device, accessing image data;

using the hard imaging device, forming a hard image using a liquid ink marking agent and the image data;

exhausting a carrier vapor resulting from the forming of the hard image using the liquid ink marking agent;

adjusting a temperature of the carrier vapor during the exhausting;

monitoring the forming the hard images; and adjusting the temperature responsive to the monitoring.

45. A hard imaging method comprising:

providing a hard imaging device configured to form a plurality of hard images using media;

using the hard imaging device, accessing image data;

using the hard imaging device, forming a hard image using a liquid ink marking agent and the image data;

exhausting a carrier vapor resulting from the forming of the hard image using the liquid ink marking agent;

adjusting a temperature of the carrier vapor during the exhausting; and wherein the adjusting comprises increasing an amount of the supplemental air provided to supplement the initial quantity of air.

46. A hard imaging method comprising:

providing a hard imaging device configured to form a plurality of hard images using media;

using the hard imaging device, accessing image data;

using the hard imaging device, forming a hard image using a liquid ink marking agent and the image data;

exhausting a carrier vapor resulting from the forming of the hard image using the liquid ink marking agent;

adjusting a temperature of the carrier vapor during the exhausting; and monitoring the temperature of the carrier vapor and the adjusting is responsive to the monitoring.

47. A hard imaging method comprising:

providing a hard imaging device configured to form a plurality of hard images using media;

using the hard imaging device, accessing image data;

using the hard imaging device, forming a hard image using a liquid ink marking agent and the image data;

exhausting a carrier vapor resulting from the forming of the hard image using the liquid ink marking agent;

adjusting a temperature of the carrier vapor during the exhausting; and wherein the adjusting comprises reducing.

* * * * *